US007370863B2

(12) United States Patent
Yasui et al.

(10) Patent No.: US 7,370,863 B2
(45) Date of Patent: May 13, 2008

(54) DUPLEX IMAGE FORMING APPARATUS WITH FEEDING ROLLER WITH AT LEAST THREE DIFFERENT SPEEDS

(75) Inventors: Kazumasa Yasui, Arakawa-ku (JP); Masaya Arakawa, Hiratsuka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 185 days.

(21) Appl. No.: 11/260,387

(22) Filed: Oct. 28, 2005

(65) Prior Publication Data

US 2006/0202411 A1 Sep. 14, 2006

(30) Foreign Application Priority Data

Mar. 10, 2005 (JP) ..... 2005-068014

(51) Int. Cl.
*B65H 5/34* (2006.01)

(52) U.S. Cl. ..... 271/270; 271/242; 271/245

(58) Field of Classification Search ..... 271/202, 271/203, 242, 245, 246, 270; 399/395, 396; 198/571, 572, 575, 810.01
See application file for complete search history.

(56) References Cited

U.S. PATENT DOCUMENTS

| | | | | |
|---|---|---|---|---|
| 3,957,366 | A | 5/1976 | Taylor et al. | |
| 4,300,756 | A | 11/1981 | Danchak et al. | |
| 4,892,301 | A | 1/1990 | Barrois et al. | |
| 4,986,528 | A | 1/1991 | Watarai et al. | |
| 5,322,273 | A | 6/1994 | Rapkin et al. | |
| 5,423,527 | A | 6/1995 | Tranquilla | |
| 5,482,265 | A | 1/1996 | Nakazato et al. | |
| 5,484,141 | A | 1/1996 | Yamashita et al. | |
| 5,575,466 | A | 11/1996 | Tranquilla | |
| 5,645,273 | A | 7/1997 | Nakagawa et al. | |
| 5,678,488 | A * | 10/1997 | Yamaguchi et al. | 101/483 |
| 5,828,939 | A | 10/1998 | Yoshiuchi et al. | |

(Continued)

FOREIGN PATENT DOCUMENTS

JP 07-223756 A 8/1995

(Continued)

OTHER PUBLICATIONS

U.S. Appl. No. 11/176,380, filed Jul. 8, 2005, Yasui.

(Continued)

*Primary Examiner*—Patrick Mackey
*Assistant Examiner*—Gerald W McClain
(74) *Attorney, Agent, or Firm*—Foley & Lardner LLP

(57) ABSTRACT

An image forming apparatus is provided. The image forming apparatus is capable of suppressing occurrence of a problem caused by misalignment of the feeding speed at the time of delivery and receipt in the intermediate feeding roller with a simple configuration without increasing costs. The image forming apparatus includes a drive controller that controls the drive speed of an intermediate feeding roller that performs skew correction for the sheet, and a feeding speed information acquisition section that acquires information relating to the feeding speed of the sheet to be fed to the intermediate feeding roller. The drive controller drives the intermediate feeding roller at least three different speeds based on the information relating to the feeding speed acquired by the feeding speed information acquisition section.

10 Claims, 6 Drawing Sheets

U.S. PATENT DOCUMENTS

| | | | | |
|---|---|---|---|---|
| 5,833,227 | A | 11/1998 | Choho et al. | |
| 5,905,934 | A | 5/1999 | Koshimizu | |
| 6,032,949 | A | 3/2000 | Ando | |
| 6,038,424 | A | 3/2000 | Nakagawa | |
| 6,135,446 | A | 10/2000 | Thiemann et al. | |
| 6,327,458 | B1 | 12/2001 | Chapman | |
| 6,374,075 | B1 | 4/2002 | Benedict et al. | |
| 6,397,035 | B2 | 5/2002 | Kataoka et al. | |
| 6,470,169 | B2 | 10/2002 | Nakazato | |
| 6,550,764 | B2 | 4/2003 | Wilson et al. | |
| 6,626,428 | B2 | 9/2003 | Soga et al. | |
| 6,641,134 | B1 | 11/2003 | Dobbertin et al. | |
| 6,644,660 | B2 | 11/2003 | Sussmeier et al. | |
| 6,669,189 | B2 | 12/2003 | Seto et al. | |
| 6,726,199 | B2 | 4/2004 | Ina et al. | |
| 6,741,831 | B2 | 5/2004 | Seto | |
| 6,931,230 | B2 | 8/2005 | Yasui | |
| 7,058,335 | B2 | 6/2006 | Sugiura et al. | |
| 7,063,472 | B2 | 6/2006 | Matsuda et al. | |
| 7,258,340 | B2 | 8/2007 | Clark et al. | |
| 2002/0039119 | A1 | 4/2002 | Igarashi | |
| 2003/0044217 | A1 | 3/2003 | Matsuda et al. | |
| 2003/0062671 | A1 | 4/2003 | Yasui et al. | |
| 2004/0080098 | A1 | 4/2004 | Yamashita et al. | |
| 2005/0062211 | A1 | 3/2005 | Botschek et al. | |
| 2005/0074267 | A1* | 4/2005 | Demchock et al. | 399/396 |
| 2006/0202407 | A1* | 9/2006 | Yasui et al. | 271/226 |
| 2007/0114717 | A1 | 5/2007 | Taniyama | |

FOREIGN PATENT DOCUMENTS

| | | | |
|---|---|---|---|
| JP | 7-223756 | A | 8/1995 |
| JP | 08-020140 | A | 1/1996 |
| JP | 10-120216 | A | 5/1998 |
| JP | 10-167511 | A | 6/1998 |
| JP | 11-020992 | A | 1/1999 |
| JP | 11-20992 | A | 1/1999 |
| JP | 11-124255 | A | 5/1999 |
| JP | 11-184191 | A | 7/1999 |
| JP | 2002-037481 | A | 2/2002 |
| JP | 2002-154682 | A | 5/2002 |
| JP | 2002-154682 | A | 5/2002 |
| JP | 2002-234629 | A | 8/2002 |

OTHER PUBLICATIONS

K. Yasui et al., U.S. PTO Notice of Allowance and Fee(s) Due, U.S. Appl. No. 11/261,788, Sep. 21, 2007, 10 pages.
U.S. Appl. No. 11/232,944, filed Sep. 23, 2005, K. Yasui et al.
U.S. Appl. No. 11/260,271, filed Oct. 28, 2005, K. Yasui et al.
U.S. Appl. No. 11/260,315, filed Oct. 28, 2005, K. Yasui et al.
U.S. Appl. No. 11/260,459, filed Oct. 28, 2005, K. Yasui et al.
U.S. Appl. No. 11/261,788, filed Oct. 31, 2005, K. Yasui et al.
K. Yasui et al., U.S. PTO Office Action, U.S. Appl. No. 11/260,315, Aug. 27, 2007, 8 pages.
K. Yasui et al., U.S. PTO Office Action, U.S. Appl. No. 11/261,788, Jan. 8, 2007, 9 pages.
K. Yasui et al., U.S. PTO Office Action, U.S. Appl. No. 11/261,788, Jun. 8, 2007, 9 pages.
K. Yasui et al., U.S. PTO Office Action, U.S. Appl. No. 11/260,271, Nov. 20, 2007, 15 pages.
K. Yasui et al., U.S. PTO Office Action, U.S. Appl. No. 11/260,315, Feb. 22, 2008, 17 pages.

* cited by examiner

DUPLEX IMAGE FORMING APPARATUS WITH FEEDING ROLLER WITH AT LEAST THREE DIFFERENT SPEEDS

BACKGROUND OF THE INVENTION

1. Field of the Invention

The present invention relates to an image forming apparatus that forms an image on a sheet to be supplied and, more particularly, to control of the drive speed of an intermediate feeding roller that feeds a sheet to a regist roller.

2. Description of the Related Art

In an image forming apparatus, an intermediate feeding roller that feeds a sheet to a regist roller (roller that performs skew correction or timing adjustment for a sheet being fed) has roles of performing sheet feeding operation at the time when an image is formed onto the sheet in cooperation with the regist roller and receiving a sheet supplied from a sheet supply cassette or sheet, onto the first surface of which an image has already been formed, fed for image forming on the second surface thereof (fed for duplex printing).

It is preferable that the sheet feeding speed of the intermediate feeding roller having the above roles be synchronized with the sheet feeding speed of a feeding roller or regist roller which is a partner for the sheet feeding operation. The sheet feeding speed with which the intermediate feeding roller should be synchronized includes a sheet supply speed (speed at which a sheet supplied from the cassette is fed to the regist roller), a process speed (sheet feeding speed when a sheet is fed through the regist roller at the time of toner image forming), and an ADU speed (feeding speed of a sheet to be resupplied for image forming onto the second surface thereof).

As a method for allowing the intermediate feeding roller to realize a plurality of different sheet feeding speeds, one in which a pulse motor is used a lot for the drive of feeding rollers that perform sheet feeding in an apparatus and one in which a plurality of clutch mechanisms are used for them can be taken. However, these methods may increase cost.

Further, even in the configuration in which the clutch mechanism is adopted to drive the intermediate feeding roller, only two different sheet feeding speeds have been realized so far (refer to, for example, Jpn. Pat. Appln. Laid-Open Publication No. 2001-130811).

In recent years, in order to increase sheet feeding efficiency, intervals between sheets tend to be short in the sheet feeding operation in which a plurality of sheets are sequentially fed. It is difficult to perform connection or stop of the clutch mechanism at a fraction of the time while performing the sequential sheet feeding operation with short sheet interval as described above. Further, misalignment in the feeding speed at the time of delivery and receipt of the sheet between rollers or the like may cause roller surface wear and sheet jamming.

SUMMARY OF THE INVENTION

The present invention has been made to solve the above problem, and an object thereof is to provide an image forming apparatus capable of suppressing occurrence of a problem caused by misalignment of the feeding speed at the time of delivery and receipt in the intermediate feeding roller with a simple configuration without increasing cost.

To solve the above problem, according to an aspect of the present invention, there is provided an image forming apparatus comprising: a drive controller that controls the drive speed of an intermediate feeding roller that feeds a sheet to a regist roller that performs skew correction for the sheet; and a feeding speed information acquisition section that acquires information relating to the feeding speed of the sheet to be fed to the intermediate feeding roller, wherein the drive controller drives the intermediate feeding roller at at least three different speeds based on the information relating to the feeding speed acquired by the feeding speed information acquisition section.

DETAILED DESCRIPTION OF THE PREFERRED EMBODIMENTS

An embodiment of the present invention will be described below with reference to the accompanying drawings.

Figure 1:
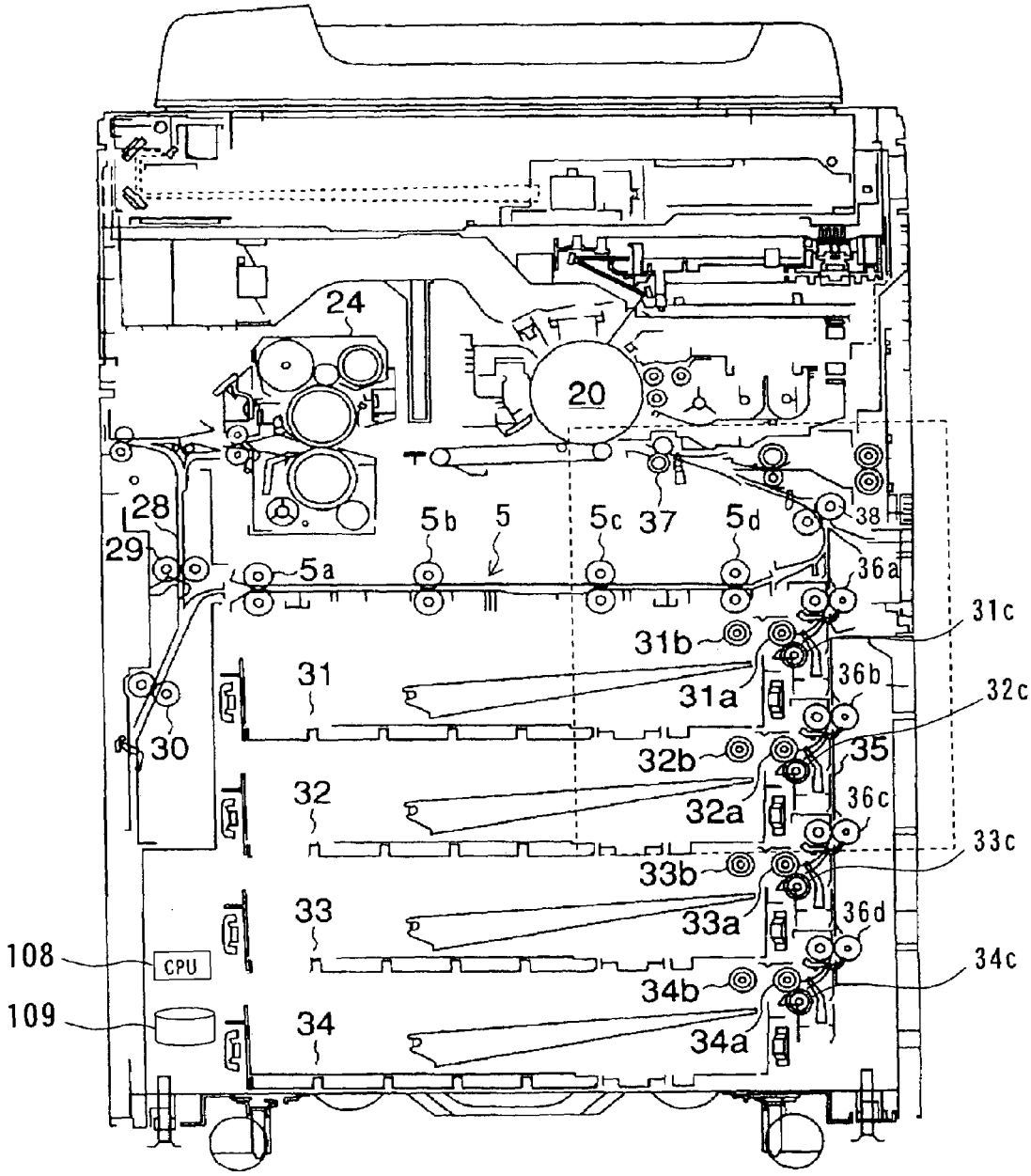
FIG. 1 is a cross-sectional view showing the entire configuration of an image forming apparatus according to an embodiment of the present invention.

FIG. 1 is a cross-sectional view showing the entire configuration of an image forming apparatus according to an embodiment of the present invention.

An image forming apparatus according to the embodiment of the present invention includes: cassettes 31, 32, 33, 34 in which sheets are stacked; pick-up rollers 31*b*, 32*b*, 33*b*, 34*b* for picking up the sheets; sheet supply rollers 31*a*, 32*a*, 33*a*, 34*a* and separating rollers 31*c*, 32*c*, 33*c*, 34*c* for feeding the sheets while separating them one by one; a sheet feeding path 35; feeding rollers 36*a* to 36*d* (motive energy for which is transferred by a clutch) for feeding the sheet from the sheet feeding path 35 to an intermediate feeding roller 38; an ADU (Automatic Duplexing Unit) 5; feeding rollers 5*a* to 5*d* (motive energy for which is transferred by a clutch) for feeding the sheet in the ADU 5; an intermediate feeding roller 38 driven by a pulse motor; a regist roller 37 for performing skew correction and timing adjustment for the sheet; a photoconductor drum 20 that forms a toner image onto the sheet; a fixing section 24 that fixes the formed toner image to the sheet; a reverse feeding path 28 to which the sheet onto which the toner image has been fixed is guided; reverse rollers 29, 30 for feeding the sheet that has been introduced in the reverse feeding path 28 in a switchback manner; a CPU 108; and a memory 109.

The following processing is performed in the image forming apparatus shown in FIG. 1. Firstly, paper sheets stacked in cassettes 31, 32, 33, or 34 are sequentially picked up by the pick-up rollers 31*b*, 32*b*, 33*b*, or 34*b*. The picked up paper sheets are fed to the sheet feeding path 35 while being separated one by one by sheet supply rollers 31*a*, 32*a*, 33*a*, or 34*a* and separating rollers 31*c*, 32*c*, 33*c*, or 34*c*. The paper sheet that has been fed to the sheet feeding path 35 is then fed to the portion in front of the intermediate feeding roller 38 by feeding rollers 36*a*, 36*b*, 36*c*, or 36*d*. The intermediate feeding roller 38 has a role of guiding the sheet that has been fed along the sheet feeding path 35 or sheet that has been fed by the ADU 5 (to be described later) to the regist roller 37 that performs skew correction or timing adjustment for the sheet.

The sheet that has been guided to the regist roller 37 through the intermediate feeding roller 38 is subjected to the skew correction or timing adjustment. After that, a toner image formed on the photoconductor surface of the photoconductor drum 20 is transferred onto the sheet. The toner image that has been transferred onto the sheet is fixed to the sheet in the fixing section 24. In the case of one-side printing, the sheet onto which the toner image has been fixed is directly discharged outside the apparatus. In the case where the duplex printing is performed or one-side printed sheet is reversed before being discharged outside, the sheet is guided to the reverse feeding path 28.

In the case of the duplex printing, the sheet that has been guided to the reverse feeding path 28 is fed to the ADU 5 in a switchback manner by reverse rollers 29 and 30. The sheet that has been fed to the ADU 5 is then fed to the intermediate feeding roller 38 again by feeding rollers 5*a* to 5*d*. After that, image forming processing is performed for the other surface of the sheet that has been fed through the ADU 5 by the photoconductor drum 20 and fixing section 24. Thus, the duplex printing for the sheet has been completed.

Figure 2:
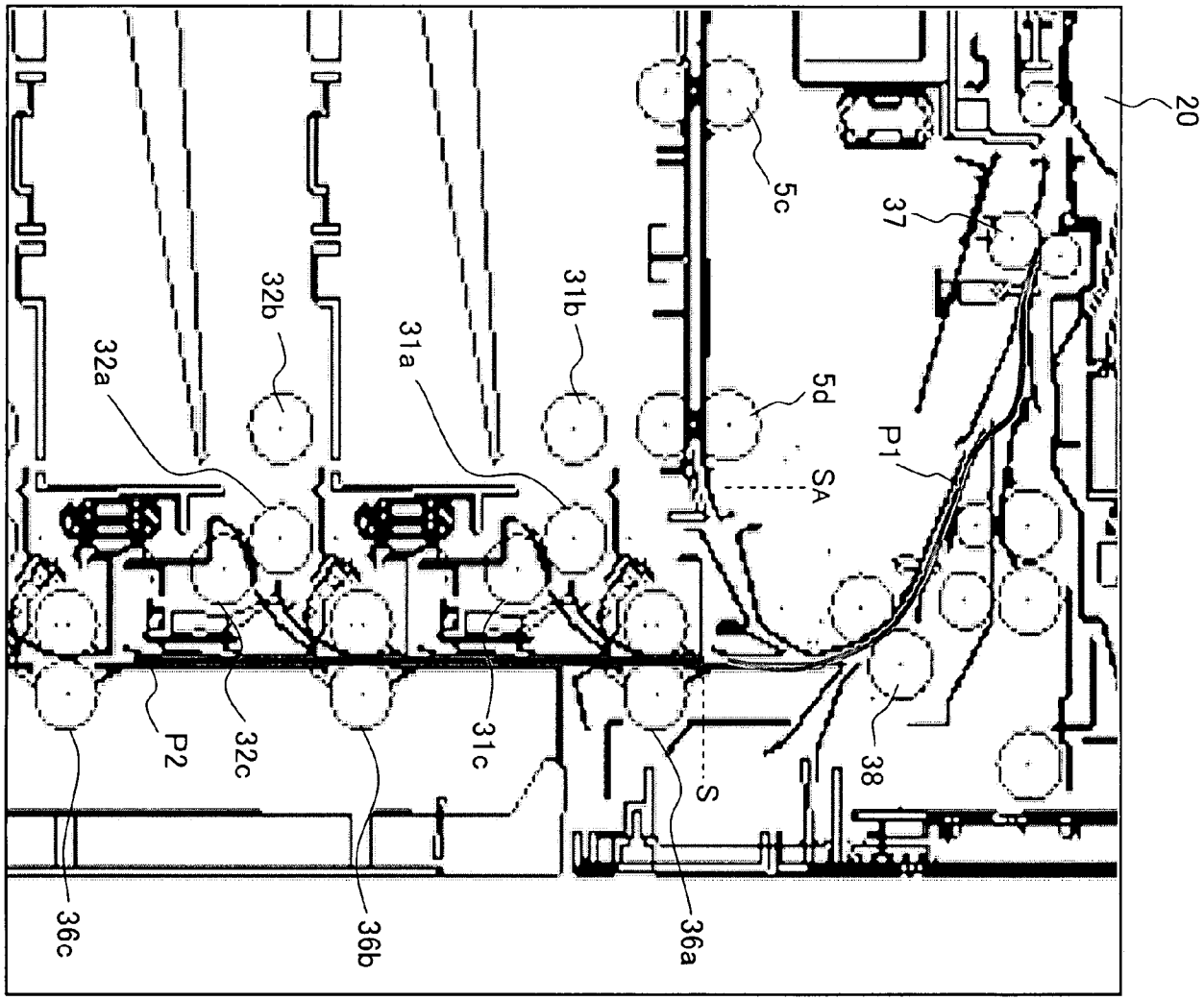
FIG. 2 is a view for explaining a sheet feeding operation at the portion in front of a regist roller and shows the area surrounded by the dotted line in FIG. 1 in an enlarged manner.

FIG. 2 is a view for explaining a sheet feeding operation at the portion in front of a regist roller and shows the area surrounded by the dotted line in FIG. 1 in an enlarged manner.

As shown in FIG. 2, in the image forming apparatus having the above configuration, in the case where image forming processing is sequentially performed for a plurality of sheets (in the case where a plurality of sheets are sequentially fed to the regist roller 37), a succeeding sheet P2 is temporarily put on standby at a predetermined position S in front of the intermediate feeding roller 38 until aligning of a preceding sheet P1 has been completed by the regist roller. Similarly, a sheet to be fed through the ADU 5 to the regist roller again is temporarily put on standby at a predetermined position $S_A$ in the ADU 5 in front of the intermediate feeding roller 38.

Figure 3:
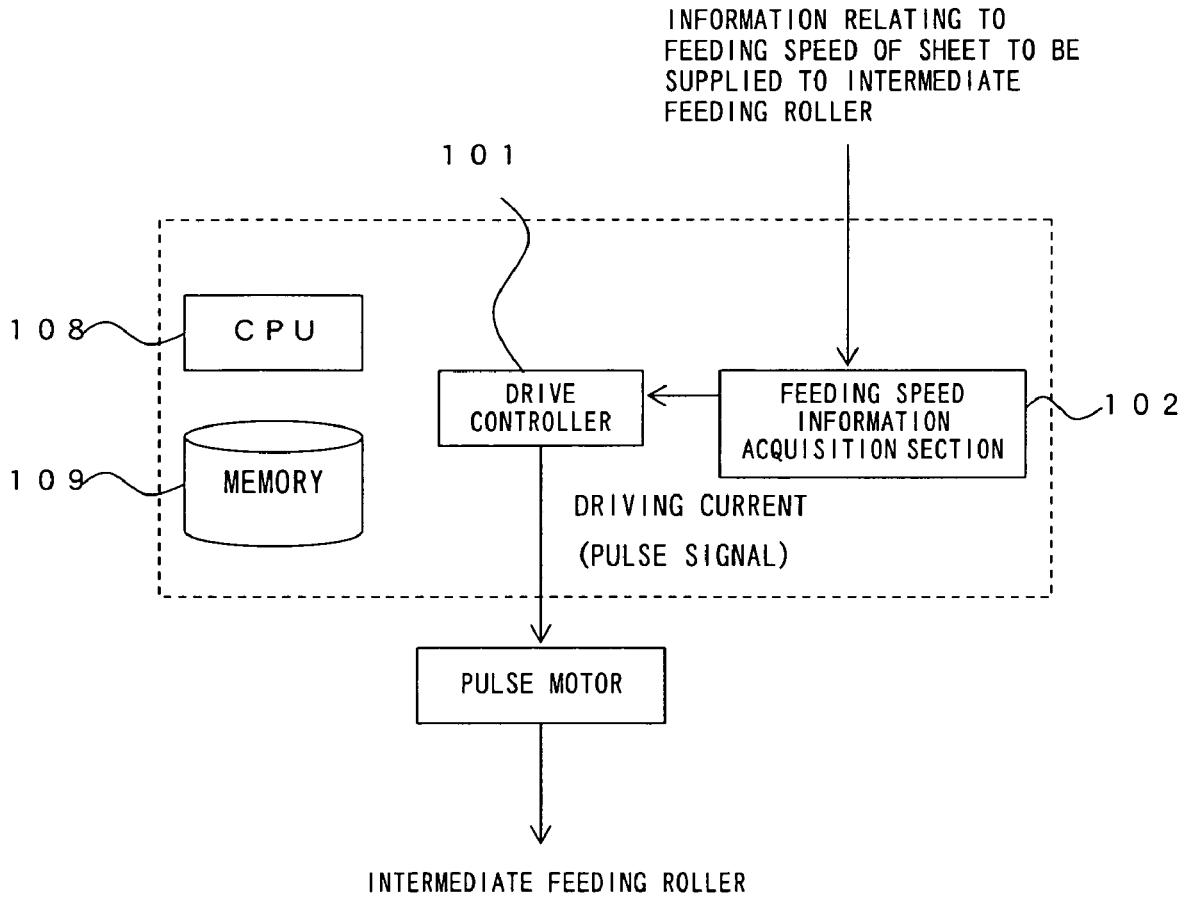
FIG. 3 is a block diagram for explaining the functional configuration of the image forming apparatus according to the embodiment.

FIG. 3 is a block diagram for explaining the functional configuration of the image forming apparatus according to the embodiment. The image forming apparatus according to the present embodiment has a drive controller 101 and a feeding speed information acquisition section 102 in addition to the configuration shown in FIGS. 1 and 2.

The drive controller 101 has a role of controlling the drive speed of the intermediate feeding roller 38 for feeding a sheet to the regist roller 37 for performing skew correction for the sheet to be fed.

The feeding speed information acquisition section 102 has a role of acquiring information relating to the feeding speed of a sheet to be fed to the intermediate feeding roller 38.

The CPU 108 has a role of performing various processing in the image forming apparatus and another role of executing a program stored in the memory 109 to realize various functions. The memory 109 is constituted by, for example, a ROM or RAM and has a role of storing various information and programs utilized in the image forming apparatus.

Further, the drive controller 101 drives the intermediate feeding roller 38 at at least three different speeds based on the information (information indicating which path the sheet is fed through, etc.) relating to the feeding speed that has been acquired by the feeding speed information acquisition section 102.

Figure 4:
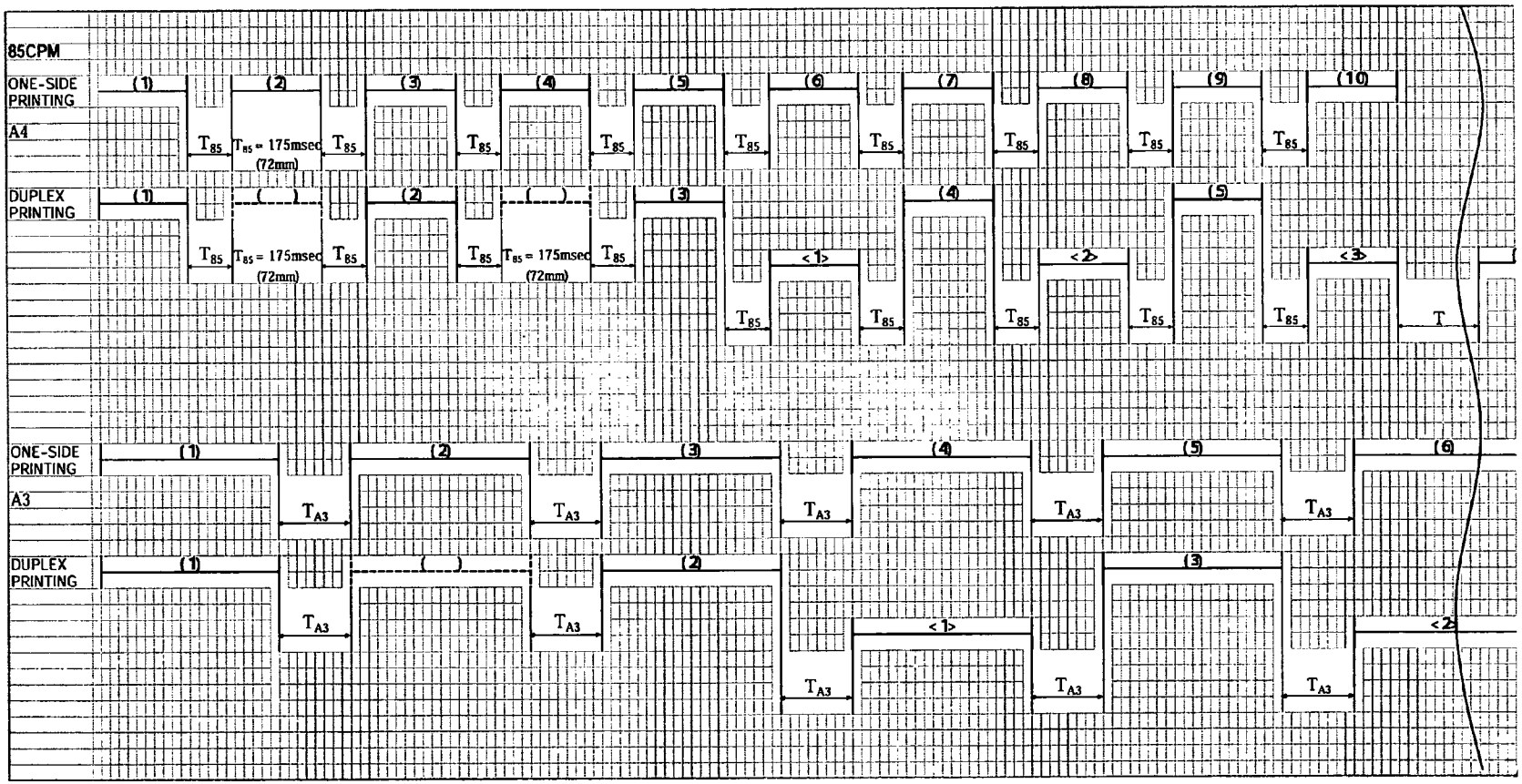
FIG. 4 is a timing chart showing sheet feeding timing at the time when duplex printing is performed for A4 size sheet and A3 size sheet.

FIG. 4 is a timing chart showing sheet feeding timing at the time when duplex printing is performed for A4 size sheet and A3 size sheet. The upper half of FIG. 4 shows a timing chart in the case where five A4 size sheets are fed in a switchback manner (85 PPM (Print Per Minute)), and the lower half shows a timing chart in the case where five A3 size sheets are fed in a switchback manner (42 PPM). Further, in the timing charts of the respective sheet sizes, upper halves show the case where the one-side printed sheet is reversed before being discharged outside, and lower halves show the case where duplex printing is performed.

In the case of the duplex printing for A4 size sheets, images are formed in the order of: front (1) of first sheet, front (2) of second sheet, front (3) of third sheet, back <1> of first sheet, front (4) of fourth sheet, back <2> of second sheet, front (5) of fifth sheet, back <3> of third sheet, back <4> of fourth sheet, and back <5> of fifth sheet.

In the case of the duplex printing for A3 size sheets, images are formed in the order of: front (1) of first sheet, front (2) of second sheet, back <1> of first sheet, front (3) of third sheet, back <2> of second sheet, front (4) of fourth sheet, back <3> of third sheet, front (5) of fifth sheet, back <4> of fourth sheet, and back <5> of fifth sheet.

Figure 5:
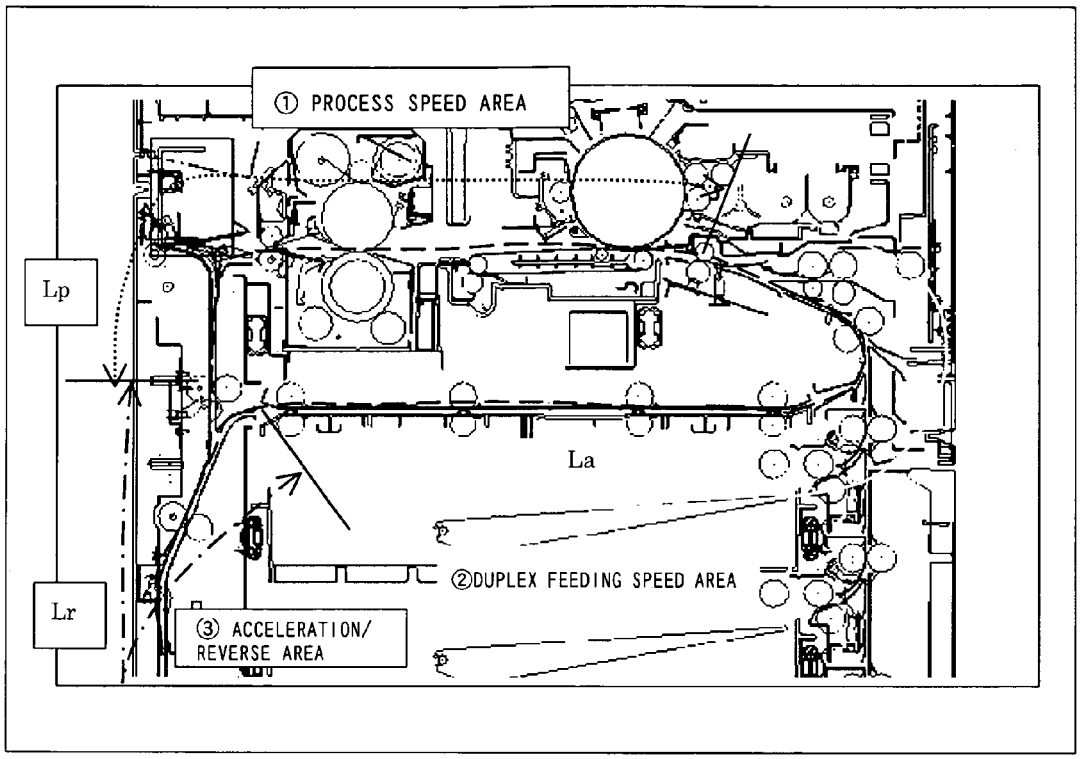
FIG. 5 is a view for explaining a sheet feeding path in the image forming apparatus according to the embodiment.

When the productivity at the time of duplex printing is calculated based on the configuration and feeding speed of the image forming apparatus according to the embodiment, the following result is obtained. FIG. 5 is a view for explaining a sheet feeding path in the image forming apparatus according to the embodiment. Here, as an example, the sheet feeding speed and distance are set as shown in FIG. 5. In FIG. 5, LP represents process speed feeding distance in process speed area, Lr represents acceleration/reverse feeding distance (switchback distance) in acceleration/reverse area, and La represents duplex speed feeding distance in duplex feeding speed area.

In order to realize, at the duplex printing time, sheet feeding efficiency (duplex productivity 100%) equivalent to the case where one-side printed sheet is reversed before being discharged outside, the starting time of the drive of the regist roller 37 can be described as below and circulation time until the regist roller 37 is restarted for feeding a sheet to the ADU 5 can be represented by the following expression, in the case of, for example, 72 PPM or 85 PPM.

TN5=60/PPM*5: circulation time {4.16 sec (72 PPM), 3.53 sec (85 PPM)}

Tat: duplex feeding total time [sec]=Ta+Tp+Tr+Tra+Tr

PPM: one side productivity (PPM for A4/LT size) 72, 85 PPM

Vp: process speed [mm/sec] 340 mm/sec, (410 mm/sec)

Vr: Reverse speed [mm/sec] 800 mm/sec

Va: ADU feeding speed [mm/sec] 385 mm/sec, (465 mm/sec)

Lp: process speed feeding distance [mm] about 367 mm

Lr: acceleration/reverse feeding distance (switchback distance) [mm] about 296 mm La: Duplex speed feeding distance [mm] about 692 mm Ta: Duplex speed feeding time [mm] 1797 sec, (1488 sec)

Lpe: sheet length [mm] 216 mm (LT)

Tpe: sheet reverse feeding time [sec] 0.369 sec

Tp: process speed feeding time [sec] 1.079 sec, (0.895 sec)

Ts: switchback time (reverse time) [sec] about 0.1 sec

Tra: regist aligning time [sec] about 0.07 sec

Tr: acceleration/reverse feeding time [sec] about 0.27 sec

To: other required time (including loss at acceleration/deceleration time and the like: 100 msec) about 0.10 sec Note that numerical values in the parentheses represent feeding data obtained in the case of 85 PPM.

It can be seen from the above that, in the case of a 72-PPM machine with a process speed of 340 mm/sec, duplex feeding total time Tat is 3.79 sec, which is smaller than 4.16 sec of circulation time TN5 of five sheets. Therefore, the processing for the five sheets satisfies the circulation condition, with the result that duplex productivity of 100% can be obtained. Similarly, in the case of an 85-PPM machine with a process speed. of 410 mm/sec, duplex feeding total time Tat is 3.29 sec, which is smaller than 3.53 sec of circulation time TN5 of five sheets. Thus, in both above cases, high duplex productivity can be obtained.

In the present embodiment, the ratio between the process speed and duplex feeding speed is set at 1:1.13 and the CPU 108 changes only the rotation number of the motor to thereby realize two process speeds. As a result, the control that satisfies duplex productivity of 100% can be realized.

Further, when a setting that satisfies the above conditions in terms of the sheet feeding distance, sheet feeding speed, printing speed (PPM) is performed, duplex productivity of 100% can be realized.

In the case where there is a restriction from sheet interval at the time of sheet supply or reverse feeding speed, it is possible to cope with it by accelerating the feeding speed at the time of duplex printing and, further, factors such as the feeding speed, process speed, PPM, duplex feeding speed, reverse feeding distance are used to easily make a calculation selection.

In the present embodiment, the drive of the motor that drives the fixing section 24 is divided, and a clutch mechanism is used to turn ON/OFF the transfer of the drive force. In the case where one side printing is sequentially performed, the clutch is turned OFF so as not to drive the feeding rollers in the ADU 5. Further, a change in the ratio of the drive force divided from the motor for the fixing section 24 at the input time can realize speed change. In addition, a change in the drives of the feeding rollers 36*a* to 36*d* after the input can also realize a change in the sheet feeding speed.

The image forming apparatus according to the present embodiment employs alternating circulation mode of "one side-both sides-one side-both sides" to perform sheet feeding control at the time of duplex printing, so that it is only necessary for the reverse feeding section or duplex feeding section to perform sheet control for the printing section one time per two sheets. Therefore, the image forming apparatus according to the present embodiment does not use a pulse motor a lot for the drive of the feeding rollers in the ADU 5 but utilizes the clutch mechanism. Even in the case where the feeding rollers in the ADU 5 are driven by the clutch mechanism, if the intermediate feeding roller 38 is driven by, for example, a pulse motor, it is possible to realize a plurality of types of feeding speeds (for example, three feeding speeds of process speed (third speed), sheet supply speed (second speed), and duplex feeding speed (first speed)) by simply changing the drive frequency of the motor. Here, the intermediate feeding roller is constituted by a roller pair. Alternatively, however, it may be constituted by a plurality of roller pairs.

An example of the ratio of process speed: sheet supply speed: duplex feeding speed is shown below.

| | | |
|---|---|---|
| 72 PPM mode 1 | 1.235 | 1.13 |
| 85 PPM mode 1 | 1.122 | 1.13 |

As described above, by setting the sheet supply speed and duplex feeding speed to a speed higher than (1 to 1.3 times) the process speed, it is possible to reduce noise and stabilize the sheet feeding control.

The intermediate feeding roller 38 according to the embodiment can realize the following three sheet feeding speeds.

(1) Sheet supply speed 420 mm/sec (2) Process speed 340 mm/sec (3) Duplex feeding speed 385 mm/sec As described above, by setting the sheet supply speed to a speed higher than the process speed, it is possible to shorten intervals between sheets to be sequentially fed and thereby to increase the number of sheets that can be fed in a given period time. Further, by setting the duplex feeding speed of the ADU 5 to a speed higher than the process speed, it is possible to realize high duplex productivity.

Figure 6:
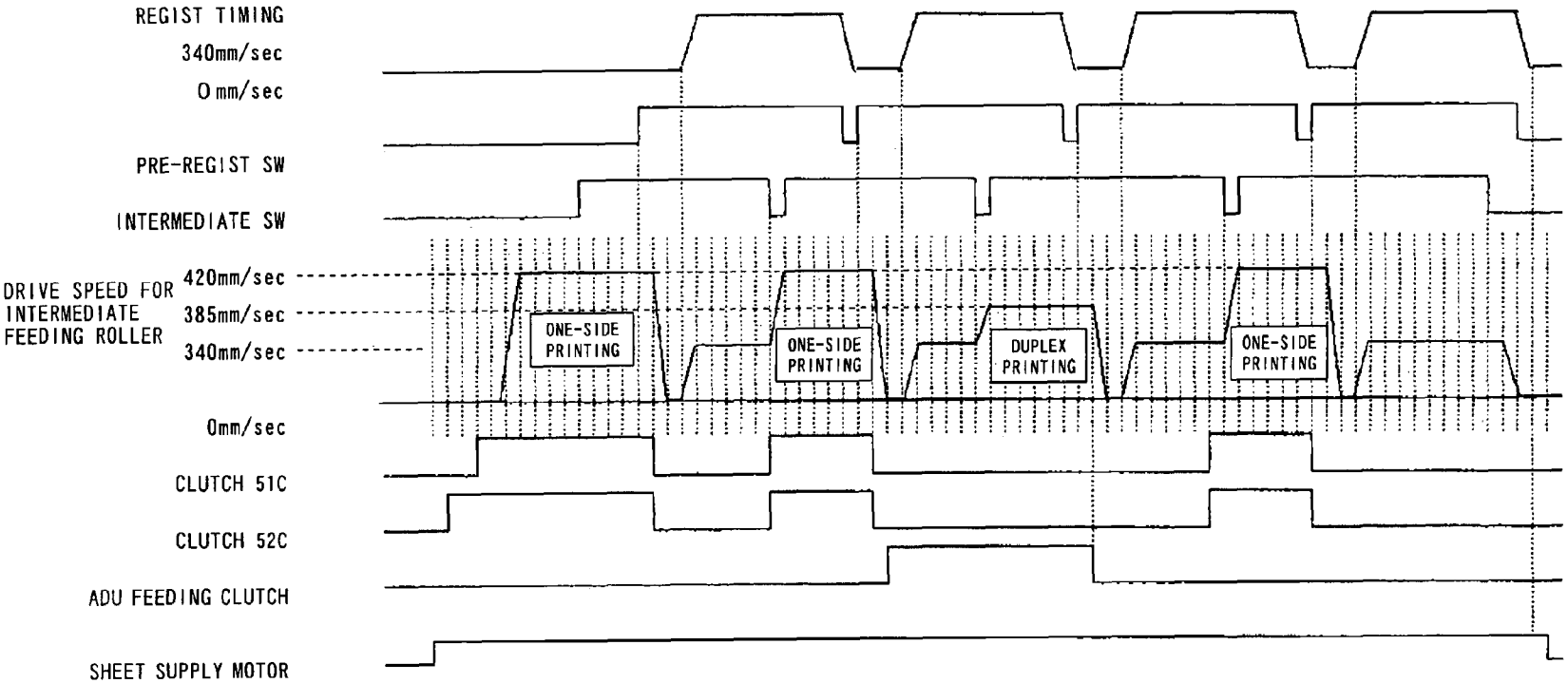
FIG. 6 is a timing chart showing drive timing of a regist roller 37, intermediate feeding roller 38, and feeding rollers other than the intermediate feeding roller 38 in the image forming apparatus according to the embodiment.

FIG. 6 is a timing chart showing drive timing of the regist roller 37, intermediate feeding roller 38, and feeding rollers other than the intermediate feeding roller 38 in the image forming apparatus according to the embodiment.

A sheet supplied from the cassette is fed by the intermediate feeding roller 38 to the regist roller 37 at a sheet supply speed of 420 mm/sec. The leading head of the sheet hits against a nip portion of the stopped regist roller 37, where aligning is performed. After that, the sheet is fed by the intermediate feeding roller 38 and regist roller 37 at a process speed of 340 mm/sec.

Subsequently, a succeeding sheet that has been temporarily put on standby for image forming onto one side thereof is fed by the intermediate feeding roller 38 to the regist roller 37 at a sheet supply speed of 420 mm/sec.

A case where image forming processing is performed for one side of the three sheets (in FIG. 6, timing chart relating to the first sheet is omitted) will be described. In order to form an image onto one side of a sheet, onto the other side of which an image has already been formed, the sheet is fed in a switchback manner. After the switchback, the sheet is fed in an accelerated manner to the portion in front of the ADU 5, where the feeding speed is slightly reduced to the ADU speed of 385 mm/sec, and the sheet is fed to the regist roller at that speed. It can be seen from FIG. 6 that at least three sheet feeding speeds are realized by the intermediate feeding roller 38.

In the sheet feeding timing chart shown in FIG. 6, a pre-regist SW serving as a sensor functions as a trigger for turning OFF the clutch. It is preferable to switch the pre-regist SW depending on the setting speed and stop time. This is because there is a possibility that a sheet bends between rollers other than those for sheet feeding, which are disposed in the so-called an aligning section and perform skew correction and timing adjustment for the sheet.

The setting of the sheet feeding speed will next be described. In general, a clutch mechanism is used for the pick-up rollers for picking-up sheets from the cassettes 31 to 34. In such a case, the sheet feeding operation may get delayed more often than that performed by ordinary rollers. For example, a sheet feeding loss is generated due to delay of clutch connection time and a sheet feeding delay of the pick-up rollers 31*b* to 34*b* is generated. Such a delay in the sheet feeding time may cause jam or decrease in copy speed. In such a case, in order to ensure a margin for the sheet feeding delay and recover the sheet feeding delay, a setting may be made to make the sheet feeding speed and process speed at the time of printing an image different from each other in some cases.

However, it is not preferable to further increase the sheet feeding speed in an apparatus that feeds a sheet at high speed because friction noise between a sheet and guide at the sheet feeding time, drive noise, noise due to hitting of a sheet to a guide at the sheet feeding time, and the like are increased. Therefore, the sheet feeding speed is set in a range in which the sheet feeding operation can be stably performed.

The setting of the sheet feeding speed at the duplex feeding time (sheet feeding operation in the ADU 5) will next be described. The setting of the sheet feeding speed at the duplex feeding time is often made individually in each machine according to the machine type or printing speed (PPM). If a higher sheet feeding speed than necessary is set, the temperatures of a drive motor and clutch are increased or it becomes difficult to perform stop control for a sheet. In the case where configuration that uses a pulse motor a lot is employed, although stable sheet feeding operation can be performed, manufacturing cost becomes increased.

In the case where two types of clutches are used to control the drive of the feeding rollers on the upstream side relative to the intermediate feeding roller 38 (in the case where a dedicated motor for driving ADU feeding rollers is not provided, and the drive force for the ADU feeding rollers is transferred from fixing drive motor or the like), the sheet feeding speed realized by the feeding rollers needs to be made equal to the process speed or needs to be changed by a drive ratio. Also in this case, by allowing the sheet feeding speed realized by the intermediate feeding roller 38, process speed, and sheet feeding speed at the time of duplex printing to change in tandem with one another, stable sheet feeding operation can be realized.

When the sheet feeding speed in the ADU 5 is made equal to the sheet supply speed, the speed of the ADU 5 needs to be increased more than required, thereby increasing noise level at the sheet supply time. Therefore, the image forming apparatus according to the present embodiment is configured to reduce the noise by driving the respective speeds in an optimum manner.

In the present embodiment, only one pulse motor is used to drive the sheet feeding rollers disposed upstream of the regist roller to thereby realize the above three sheet feeding speeds, that is, the sheet supply speed required for feeding a sheet from the cassette; process speed for elongating the life of the photoconductor or consumable supply such as a development material; and duplex feeding speed for obtaining optimum sheet feeding speed of state productivity 100% (a state in which there is no difference in speed between one side printing and duplex printing, that is, at the time when the efficiency is maximum at the alternating circulation between them: except for the feeding time of the first and second sheets and the last two sheets after the completion of the duplex printing) with high duplex productivity.

The configuration obtained by adding only one pulse motor to the conventional configuration as described above satisfies three capabilities of stability in paper feeding operation, increase in the life of consumable supply (or increase in copy speed can be achieved), and high duplex productivity required in the image forming apparatus. At the time of duplex printing, sheet feeding speed can freely be set without the need of setting unnecessary sheet feeding speed.

As described above, in the embodiment of the present invention, the drive controller 101 drives the intermediate feeding roller 38 at at least three different speeds including the first speed at which a sheet, which is to be resupplied to the intermediate feeding roller 38 for image forming onto the second surface thereof after it has been passed through the regist roller 37 and a toner image has been formed onto the first surface thereof, is received by the intermediate feeding roller 38 and the second speed at which a sheet, which is to be newly fed to the intermediate feeding roller 38, is received by the intermediate feeding roller 38. Further, the drive controller 101 controls the intermediate feeding roller 38 such that the first speed becomes lower than the second speed. Although the PPM is taken as an example of the printing speed in the present embodiment, the same applies to CPM (Copy Per Minute) used in copy processing.

While the present invention has been described in detail according to the specific embodiment, it will be apparent to those skilled in the art that variations and modifications are possible without deviating from the broad principles and spirit of the present invention.

As has been described in detail, according to the present invention, it is possible to provide an image forming apparatus capable of suppressing occurrence of a problem caused by misalignment of the feeding speed at the time of delivery and receipt in the intermediate feeding roller with a simple configuration without increasing cost.

This application claims priority from Japanese Patent Application 2005-068014, filed Mar. 10, 2005, which is incorporated herein by reference in its entirety.

What is claimed is:

1. An image forming apparatus, comprising:

a drive controller that controls the drive speed of an intermediate feeding roller that feeds a sheet to a regist roller that performs skew correction for the sheet; and a feeding speed information acquisition section that acquires information relating to the feeding speed of the sheet to be fed to the intermediate feeding roller, wherein the drive controller drives the intermediate feeding roller at at least three different speeds based on the information relating to the feeding speed acquired by the feeding speed information acquisition section, wherein the drive controller drives the intermediate feeding roller at at least three different speeds including a first speed at which a sheet, which is to be resupplied to the intermediate feeding roller for image forming onto a second surface thereof after the sheet has been passed through the regist roller and a toner image has been formed onto a first surface thereof, is received by the intermediate feeding roller and a second speed at which a sheet, which is to be newly fed to the intermediate feeding roller, is received by the intermediate feeding roller, and the drive controller controls the intermediate feeding roller such that the first speed becomes lower than the second speed.

2. An image forming apparatus, comprising:

a drive controller that controls the drive speed of an intermediate feeding roller that feeds a sheet to a regist roller that performs skew correction for the sheet; and a feeding speed information acquisition section that acquires information relating to the feeding speed of the sheet to be fed to the intermediate feeding roller, wherein the drive controller drives the intermediate feeding roller at at least three different speeds based on the information relating to the feeding speed acquired by the feeding speed information acquisition section, wherein the drive controller drives the intermediate feeding roller at at least three different speeds including a first speed at which a sheet, which is to be resupplied to the intermediate feeding roller for image forming onto the second surface thereof after it has been passed through the regist roller and a toner image has been formed onto the first surface thereof, is received by the intermediate feeding roller, a second speed at which a sheet, which is to be newly fed to the intermediate feeding roller, is received by the intermediate feeding roller, and wherein the intermediate feeding roller is driven at a third speed at which a sheet is passed through the regist roller and a toner image is formed thereon, and the drive controller controls the intermediate feeding roller such that the first speed becomes higher than the third speed.

3. The image forming apparatus according to claim 1, wherein the intermediate feeding roller is driven by a pulse motor.

4. The image forming apparatus according to claim 1, wherein the motive force for driving a feeding roller that supplies the intermediate feeding roller with a sheet is transferred by a clutch.

5. An image forming apparatus comprising: a drive controller that controls the drive speed of an intermediate feeding roller that feeds a sheet to a regist roller that performs skew correction for the sheet; and a feeding speed information acquisition section that acquires information relating to the feeding speed of the sheet to be fed to the intermediate feeding roller, wherein the drive controller drives the intermediate feeding roller at at least three different speeds based on the information relating to the feeding speed acquired by the feeding speed information acquisition section, wherein the drive controller drives the intermediate feeding roller at at least three different speeds including a first speed at which a sheet, which is to be resupplied to the intermediate feeding roller for image forming onto the second surface thereof after it has been passed through the regist roller and a toner image has been formed onto the first surface thereof, is received by the intermediate feeding roller and a second speed at which a sheet, which is to be newly fed to the intermediate feeding roller, is received by the intermediate feeding roller, and the drive controller controls the intermediate feeding roller such that the first speed becomes lower than the second speed, and wherein the drive controller drives the intermediate feeding roller at at least three different speeds including a first speed at which a sheet, which is to be resupplied to the intermediate feeding roller for image forming onto the second surface thereof after it has been passed through the regist roller and a toner image has been formed onto the first surface thereof, is received by the intermediate feeding roller, a second speed at which a sheet, which is to be newly fed to the intermediate feeding roller, is received by the intermediate feeding roller, and a third speed at which a sheet is passed through the regist roller and a toner image is formed thereon, and the drive controller controls the intermediate feeding roller such that the first speed becomes higher than the third speed.

6. An image forming method, comprising:

controlling the drive speed of an intermediate feeding roller that feeds a sheet to a regist roller that performs skew correction for the sheet; and acquiring information relating to the feeding speed of the sheet to be fed to the intermediate feeding roller, wherein the controlling step drives the intermediate feeding roller at at least three different speeds based on the information relating to the feeding speed acquired by the acquiring step, and wherein the controlling step drives the intermediate feeding roller at at least three different speeds including a first speed at which a sheet, which is to be resupplied to the intermediate feeding roller for image forming onto the second surface thereof after it has been passed through the regist roller and a toner image has been formed onto the first surface thereof, is received by the intermediate feeding roller and a second speed at which a sheet, which is to be newly fed to the intermediate feeding roller, is received by the intermediate feeding roller, and the controlling step controls the intermediate feeding roller such that the first speed becomes lower than the second speed.

7. The image forming method of claim 6, wherein the controlling step drives the intermediate feeding roller at at least three different speeds including a first speed at which a sheet, which is to be resupplied to the intermediate feeding roller for image forming onto the second surface thereof after it has been passed through the regist roller and a toner image has been formed onto the first surface thereof, is received by the intermediate feeding roller, a second speed at which a sheet, which is to be newly fed to the intermediate feeding roller, is received by the intermediate feeding roller, and a third speed at which a sheet is passed through the regist roller and a toner image is formed thereon, and the controlling step controls the intermediate feeding roller such that the first speed becomes higher than the third speed.

8. The image forming method according to claim 6, wherein the intermediate feeding roller is driven by a pulse motor.

9. The image forming method according to claim 6, wherein the motive force for driving a feeding roller that supplies the intermediate feeding roller with a sheet is transferred by a clutch.

10. An image forming method, comprising:

controlling the drive speed of an intermediate feeding roller that feeds a sheet to a regist roller that performs skew correction for the sheet; and acquiring information relating to the feeding speed of the sheet to be fed to the intermediate feeding roller, wherein the controlling step drives the intermediate feeding roller at at least three different speeds based on the information relating to the feeding speed acquired by the acquiring step, wherein the controlling step drives the intermediate feeding roller at at least three different speeds including a first speed at which a sheet, which is to be resupplied to the intermediate feeding roller for image forming onto the second surface thereof after it has been passed through the regist roller and a toner image has been formed onto the first surface thereof, is received by the intermediate feeding roller and a second speed at which a sheet, which is to be newly fed to the intermediate feeding roller, is received by the intermediate feeding roller, and the controlling step controls the intermediate feeding roller such that the first speed becomes lower than the second speed, and wherein the controlling step drives the intermediate feeding roller at at least three different speeds including a first speed at which a sheet, which is to be resupplied to the intermediate feeding roller for image forming onto the second surface thereof after it has been passed through the regist roller and a toner image has been formed onto the first surface thereof, is received by the intermediate feeding roller, a second speed at which a sheet, which is to be newly fed to the intermediate feeding roller, is received by the intermediate feeding roller, and a third speed at which a sheet is passed through the regist roller and a toner image is formed thereon, and the controlling step controls the intermediate feeding roller such that the first speed becomes higher than the third speed.

* * * * *